US008418844B2

(12) United States Patent
Slaters, Jr. et al.

(10) Patent No.: US 8,418,844 B2
(45) Date of Patent: Apr. 16, 2013

(54) CONTAINER CARRIER STRING

(75) Inventors: Arthur R. Slaters, Jr., Arlington Heights, IL (US); George E. Waldo, II, Chicago, IL (US); Leslie S. Marco, Westmont, IL (US); Robert C. Olsen, Medinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/617,423

(22) Filed: Nov. 12, 2009

(65) Prior Publication Data

US 2010/0140121 A1 Jun. 10, 2010

Related U.S. Application Data

(60) Provisional application No. 61/119,968, filed on Dec. 4, 2008.

(51) Int. Cl.
*B65D 75/00* (2006.01)

(52) U.S. Cl.
USPC ..... 206/150; 206/151; 206/427; 206/428; 206/223; 206/820; 294/87.2

(58) Field of Classification Search ..... 206/150, 206/151, 446, 427, 428, 223, 162, 139, 494, 206/499, 820; 294/87.2
See application file for complete search history.

(56) References Cited

U.S. PATENT DOCUMENTS

| | | | | |
|---|---|---|---|---|
| 3,285,405 | A * | 11/1966 | Wanderer | 206/499 |
| 3,778,096 | A * | 12/1973 | Smith | 294/87.2 |
| 3,938,656 | A | 2/1976 | Owen | |
| 5,038,928 | A | 8/1991 | Marco et al. | |
| 5,072,829 | A | 12/1991 | Marco et al. | |
| 5,255,780 | A * | 10/1993 | Olsen | 206/150 |
| 5,511,656 | A * | 4/1996 | Olsen | 206/150 |
| 6,068,125 | A | 5/2000 | Slaters, Jr. et al. | |
| 7,975,841 | B2 * | 7/2011 | Marco et al. | 206/150 |
| 2007/0193889 | A1 * | 8/2007 | Olsen et al. | 206/150 |
| 2009/0057354 | A1 * | 3/2009 | Marco et al. | 224/148.6 |

* cited by examiner

*Primary Examiner* — J. Gregory Pickett
*Assistant Examiner* — Blaine Neway
(74) *Attorney, Agent, or Firm* — Pauley Petersen & Erickson

(57) ABSTRACT

A generally continuous string of container carriers typically forming a package of fan-folded container carriers wherein the generally continuous string of container carriers are folded within a carton along a first attachment area and a second attachment area between adjacent container carriers of the plurality of container carriers and perforations are formed at least partially across the first attachment area and the second attachment area and include a series of small cuts and dividing apertures.

14 Claims, 3 Drawing Sheets

CONTAINER CARRIER STRING

CROSS REFERENCE TO RELATED APPLICATION

This application claims the benefit of U.S. Provisional Patent Application Ser. No. 61/119,968, filed on 4 Dec. 2008. The Provisional Patent Application is hereby incorporated by reference herein in its entirety and is made a part hereof, including but not limited to those portions which specifically appear hereinafter.

BACKGROUND OF THE INVENTION

1. Field of the Invention

This invention relates to an apparatus and method for fan-folding container carriers, particularly those having a handle and/or a panel, in a space-efficient manner.

2. Description of Prior Art

Container carriers are used to unitize a plurality of containers. Typical containers are bottles, cans and other containers having a sidewall and a neck, chime or raised rib around an upper portion of the container. Container carriers typically connect two or more containers into a sturdy unitized package of containers. Container carriers are generally planar arrays of rings, sometimes referred to as "six-pack carriers," and may be formed from a thermoplastic sheet material.

The thermoplastic sheet material is typically extruded and then punched so that large numbers of container carriers are formed end to end resulting in continuous elongated strings or strips of container carriers. Unless specified otherwise, container carriers as used in this specification are defined as the continuous elongated string of container carriers prior to application onto containers and subsequent division into individual container carriers.

Prior art methods of packaging container carriers involve accumulating the elongated strings of container carriers onto reels. The reels of container carriers are unwound at a later time during application onto containers. The reel method of storing and applying the container carriers to containers requires splicing the end of one reel with the beginning of the following reel without interrupting the application process. In addition, the reel method of storing and applying carriers is generally limited to reels of a size which may be physically lifted and manipulated by the applicating machine operator. Also, the reel unwinding equipment must accommodate the inertia and resultant backlash inherent in unwinding a wound strip of material. Further, the generally circular or octagonal shape of the reels limits the number of reels which may be assembled onto a single pallet for shipment between the production facility and the application facility.

Wanderer, U.S. Pat. No. 3,285,405, and Slaters Jr. et al., U.S. Pat. No. 6,068,125, incorporated by reference herein, disclose methods for storing and dispensing container carriers wherein elongated strings of container carriers are fan folded, similar to pin-feed computer paper, into boxes or cartons. The container carriers are dispensed from the boxes or cartons during the application process and successive boxes or cartons containing stacks of container carriers are spliced together as the boxes empty.

However, such methods for storing and dispensing container carriers may lead to uneven accumulation of the container carriers at each end of the box or carton, specifically where the container carriers are folded over onto each other. More particularly, when the container carrier includes a handle, a panel or some other extraneous feature, uneven stacking and/or unwinding is even more problematic. As a result, cartons may suffer from uneven stacks of folded container carriers whereby a central portion of the carton is not filled to capacity and end portions of the carton include distinctly higher stacks of carriers. This problem is referred to as "birdsnesting" and may result in inefficiently packed cartons of container carriers and even tangling of the string of container carriers during the unwinding process.

SUMMARY OF THE INVENTION

This invention provides a package of container carriers which allows for space-efficient storage of stacks of container carriers and permits uninterrupted removal of a mostly continuous elongated strip of container carriers.

A package of container carriers for shipment and storage and subsequent application to groups of containers is constructed to contain fan folded stacks of container carriers. Elongated strips of container carriers are fan folded, like pin-feed computer paper, into a plurality of stacks of container carriers.

According to a preferred embodiment of this invention, a generally continuous string of container carriers is formed that includes a first attachment area and a second attachment area between each adjacent container carrier. Each of the first attachment area and the second attachment area preferably includes a dividing aperture together with one or more perforations formed on either side of the dividing aperture at least partially across the first attachment area.

The dividing apertures and perforations are preferably configured to maximize the generally flat and continuous folding of the container carriers. One preferred embodiment of the first and second attachment areas includes an oval dividing apertures with two small cuts formed on either side. Specifically, the first attachment area includes a group of two small cuts formed on either side of an oval dividing aperture and the second attachment area includes a group of two small cuts formed on either side of an oval dividing aperture. The dividing aperture is preferably concentrated in a central portion of the first attachment area.

In this manner, a stack of container carriers may be fan folded without unequal accumulation, birdsnesting or otherwise tangling container carriers as they are moved to or from the package.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

FIGS. 1-5 variously show container carriers 10 as the term is used in the claimed invention. Container carriers 10 are preferably arranged in a generally continuous elongated string or strip having weakened areas between adjacent individual container carriers. According to a preferred embodiment of this invention, container carriers 10 comprise a single layer of material, however, traditional "welded" two layer carriers may also be used in connection with this invention.

Figure 1:
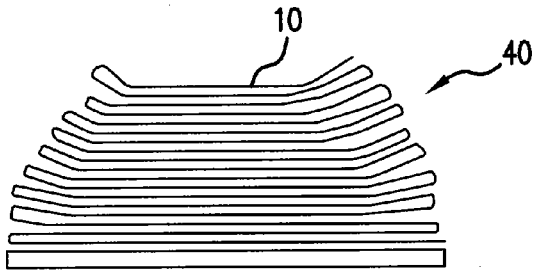
FIG.1 PRIOR ART
FIG. 1 is a representative side view of a stack of container carriers exhibiting "birdsnesting" according to the prior art.

FIG. 1 shows a single fan folded stack 40 of container carriers 10 exhibiting "birdsnesting" whereby stack 40 is unevenly accumulated, for instance, the folded edges of stack 40 are higher than a central portion of stack 40. This condition may cause problems in drawing the generally continuous string of container carriers 10 from package 1, including tangling and buckling of stack 40. As a result, container carriers 10 may break before arriving at an applicating machine or as it enters a feed trough of the applicating machine. The single layer container carrier 10 may be more prone to birdsnesting and improper breaking or separation during unwinding and/or application.

Figure 2:
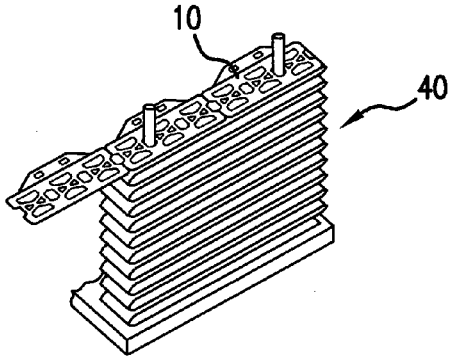
FIG. 2 is a side perspective view of a stack of container carriers according to one preferred embodiment of this invention.

FIG. 2 shows a single fan folded stack 40 of container carriers 10 according to one preferred embodiment of this invention. The elongated strip of container carriers 10 are preferably fan folded back and forth in alternating opposite directions resulting in horizontally extending rows of container carriers 10 forming a vertically extending stack 40. Fan folding container carriers 10, like pin-feed computer paper, preferably results in stack 40 wherein a large amount of container carriers 10 are folded into a minimum amount of space.

Figure 3:
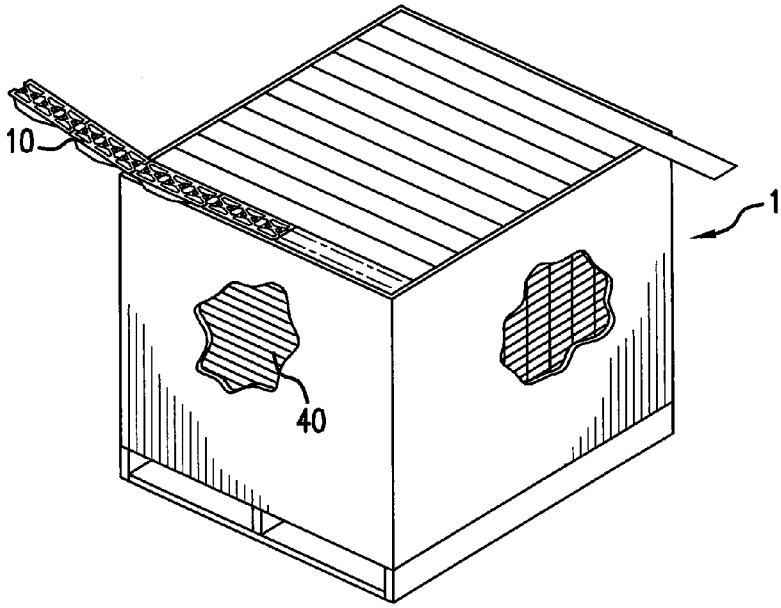
FIG. 3 is a side perspective view of a carton or package of container carriers according to one preferred embodiment of this invention.

FIG. 3 shows package 1 of container carriers 10 according to one preferred embodiment of this invention. During the production process, container carriers 10 are preferably formed in the generally continuous, elongated string for shipment and storage in packaging, such as carton or package 1. After shipment to an application facility, such as a soft drink bottler, container carriers 10 are preferably removed from the packaging and applied, on an applicating machine, to groups of containers, such as cans, during which application container carriers 10 are separated from the elongated strip and into individual container carrier packages.

Figure 4:
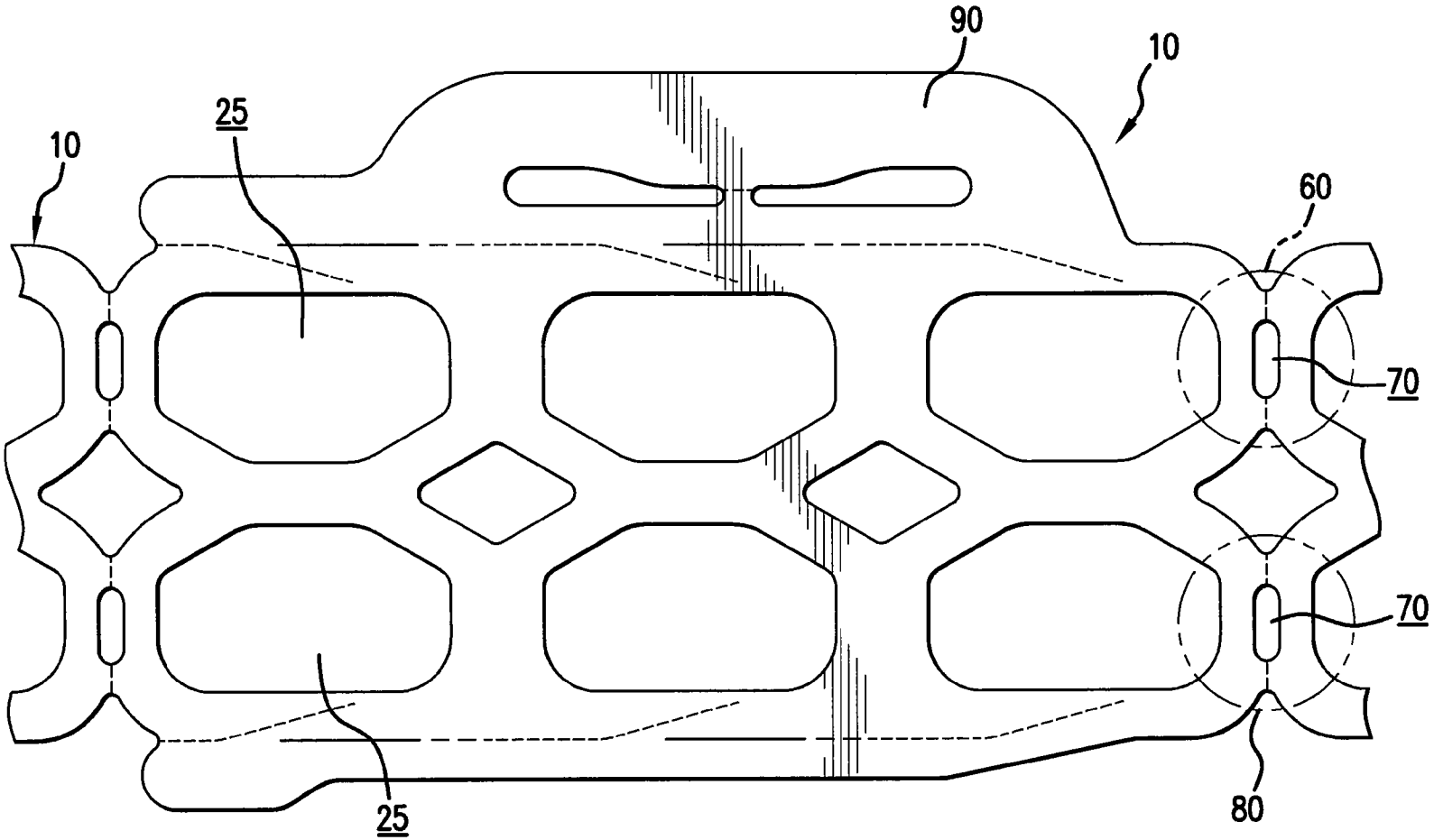
FIG. 4 is a side elevational view of a string of container carriers according to one preferred embodiment of this invention.

According to a preferred embodiment of this invention, such as shown in FIG. 4, container carriers 10 include a plurality of container receiving apertures 25 for engaging a plurality of containers to form a multipackage. Preferably, a generally continuous string of container carriers is formed that includes first attachment area 60 and second attachment area 80 formed between each adjacent container carrier 10. First and second attachment areas 60, 80 preferably comprise a dividing apertures 70 and one or more perforations 50 formed at least partially across each of first attachment area 60 and second attachment area 80.

Figure 5:
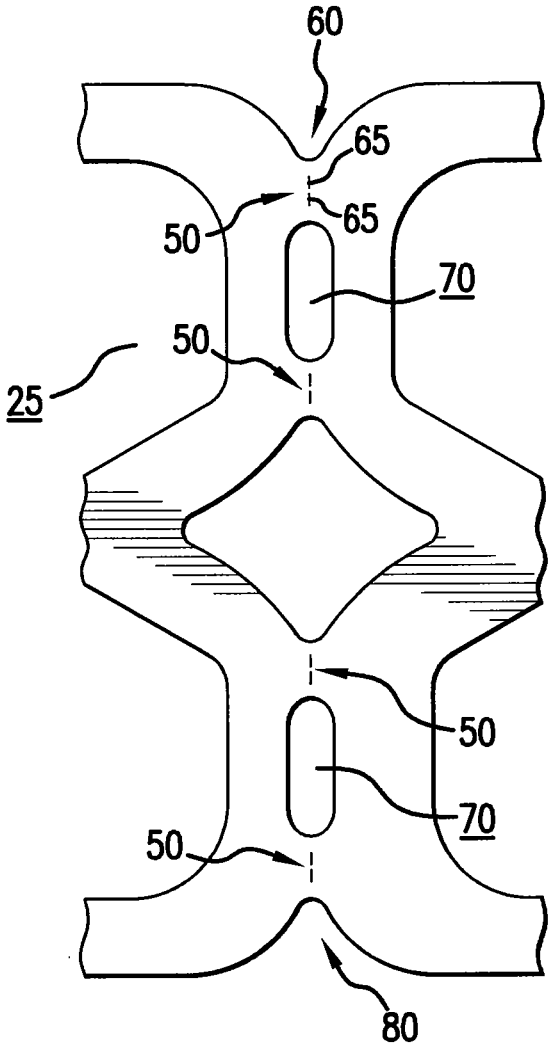
FIG. 5 is a magnification of the attachment areas between container carriers according to one preferred embodiment of this invention.

FIG. 5 shows one preferred embodiment of first attachment area 60 and second attachment area 80 that each include a pair of small cuts 65 on either side of a dividing aperture 70. As used in the specification and claims, "small cut" means a perforation of a relatively small size compared with a length of dividing aperture 70. Specifically, first attachment area 60 and second attachment area 80 of FIG. 5 each show a group of two small cuts 65 formed on either side of dividing aperture 70 having a generally oval configuration. As shown in FIG. 5, small cuts 65 have a smaller length than dividing apertures 70.

As shown in FIG. 4, the generally continuous string of continuous container carriers 10 preferably further includes container carriers 10 each having handle 90 and/or similar feature formed along a longitudinal edge. Handle 90 as shown in FIG. 4 permits a "side lift" configuration in a resulting multipackage. As a result of this configuration, handle 90 extends outwardly from the bands defining the container receiving apertures 25 and independent from first and second attachment areas 60, 80. This outwardly extending feature leads to additional problems in fan folding. In particular, such features extending from container carriers 10 such as handle 90, exacerbate birdsnesting associated with fan folding strings of container carriers 10. As a result, a suitable solution that permits fan folding of single layer container carriers 10 having handles 90 or similar external features while still avoiding some of the traditional pitfalls of fan folded container carriers 10 is achieved through the configurations described herein.

The plurality of perforations 50 and dividing apertures 70 in first attachment area 60 and second attachment area 80 are preferably configured to permit folding the string of continuous container carriers 10 so that the resulting stack 40 lies relatively flat and horizontal within package 1, such as the carton shown in FIG. 3. The arrangement of short cuts 65 and a generally oval shaped dividing aperture 70 having tapered and minimally radiused ends results in easier and cleaner separation of container carriers 10 from the string.

In addition, the configuration of cuts and apertures formed in each attachment area 60, 80 minimizes the occurrence of "gouging" between adjacent container carriers 10 when the container carriers 10 are separated from the string.

In a preferred embodiment of the invention shown in FIG. 3, package 1 comprises a carton. The carton may contain one or more stacks 40 of container carriers 10. A method for assembling package 1 of container carriers 10 is required that results in an efficiently filled package 1 and permits uninterrupted removal of a mostly continuous elongated strip of container carriers 10. In one preferred embodiment of this invention, package 1 is simultaneously loaded with multiple stacks 40 of container carriers 10. Preferably, though not necessarily, each stack 40 of container carriers 10 is separated and/or positioned using one or more dividers to maintain position of and spacing between the various stacks 40 of container carriers 10. This configuration helps prevent tangling and other problems encountered during loading and unloading of package 1.

In a preferred embodiment of this invention, each additional stack 40 of container carriers 10 that is added to package 1 is connected to the previous stack 40 of container carriers 10. Preferably, an end container carrier at a bottom of a first stack 40 of container carriers 10 is connected with a beginning container carrier at a top of an additional stack 40 of container carriers 10. The end container carrier is preferably connected or spliced with the beginning container carrier using a weld attachment or a heat seal. Adjacent stacks 40 of container carriers 10 may also be connected using other methods known to those having skill in the art.

While in the foregoing specification this invention has been described in relation to certain preferred embodiments thereof, and many details have been set forth for purposes of illustration, it will be apparent to those skilled in the art that the apparatus is susceptible to additional embodiments and that certain of the details described herein can be varied considerably without departing from the basic principles of the invention.

The invention claimed is:

1. A generally continuous string of container carriers, each container carrier for unitizing a plurality of containers, the generally continuous string of container carriers comprising:

a plurality of adjacent container carriers, each container carrier comprising two or more pairs of container receiving apertures;

a first attachment area between each adjacent container carrier of the plurality of container carriers;

a second attachment area between each adjacent container carrier of the plurality of container carriers; and an aperture dividing the first attachment area from the second attachment area;

a dividing aperture formed only in each of the first attachment area and the second attachment area, wherein the dividing aperture is generally oval shaped having two tapered and minimally radiused ends; and a perforation formed on each side of the dividing apertures; and a carton wherein the generally continuous string of container carriers are fan folded within the carton.

2. The generally continuous string of container carriers of claim 1 further comprising:

a handle formed along a longitudinal edge of each adjacent container carrier, the handle extending outwardly from the container carrier and independent of the first attachment area and the second attachment area.

3. The generally continuous string of container carriers of claim 1 wherein the perforation includes two small cuts.

4. The generally continuous string of container carriers of claim 1 wherein each attachment area includes two small cuts formed on either side of a generally oval shaped dividing aperture.

5. The generally continuous string of container carriers of claim 1 wherein the dividing aperture is centered within the first attachment area.

6. A generally continuous string of container carriers, each container carrier for unitizing a plurality of containers, the generally continuous string of container carriers comprising:

a plurality of adjacent container carriers, each container carrier comprising two or more pairs of container receiving apertures;

a first attachment area and a second attachment area between each adjacent container carrier of the plurality of container carriers;

an aperture positioned between the first attachment area and the second attachment area;

a plurality of small cuts formed at least partially across the first attachment area and the second attachment area;

a dividing aperture having a generally oval shape formed between the plurality of small cuts in only each of the first attachment area and the second attachment area, wherein the dividing aperture includes tapered and minimally radiused ends; and a carton wherein the generally continuous string of container carriers are fan folded within the carton.

7. The generally continuous string of container carriers of claim 6 further comprising a handle positioned along a longitudinal edge of each container carrier of the generally continuous string of container carriers.

8. The generally continuous string of container carriers of claim 7 wherein the handle extends outwardly from each container carrier and independently of the first attachment area and the second attachment area.

9. The generally continuous string of container carriers of claim 6 wherein two small cuts are formed on either side of the dividing aperture.

10. The generally continuous string of container carriers of claim 6 consisting of a single layer of material.

11. A package of container carriers comprising:

a carton;

a generally continuous string of container carriers, each container carrier comprising two or more pairs of container receiving apertures, the generally continuous string of container carriers folded within the carton along a first attachment area and a second attachment area between adjacent container carriers of the plurality of container carriers, the first attachment area separated from the second attachment area by an aperture; and a plurality of perforations formed at least partially across the first attachment area and the second attachment area including a series of small cuts and dividing apertures, wherein the dividing apertures comprise a generally oval shape having tapered and minimally radiused ends and is formed only within the first attachment area and the second attachment area, wherein the series of small cuts are formed on each side of the dividing apertures.

12. The package of claim 11 further comprising a handle positioned along a longitudinal edge of each container carrier of the generally continuous string of container carriers.

13. The package of claim 12 wherein the handle extends outwardly from each container carrier and independently of the first attachment area and the second attachment area.

14. The package of claim 11 wherein the generally continuous string of container carriers consists of a single layer of material.

* * * * *